United States Patent [19]

Hein et al.

[11] 4,262,610

[45] Apr. 21, 1981

[54] METHOD OF REDUCING THE SULFUR EMISSIONS FROM BOILERS FIRED WITH BROWN COAL AND, MORE GENERALLY, FROM BOILERS FIRED WITH LOW-RANK SOLID FOSSIL FUELS AND USED IN THE PRODUCTION OF ELECTRIC POWER

[75] Inventors: Klaus Hein, Bergheim; Ansgar Schiffers, Aachen, both of Fed. Rep. of Germany

[73] Assignee: Rheinisch-Westfälisches Elektrizitätswerk AG, Fed. Rep. of Germany

[21] Appl. No.: 46,603

[22] Filed: Jun. 8, 1979

Related U.S. Application Data

[63] Continuation-in-part of Ser. No. 8,764, Feb. 1, 1979, abandoned.

[30] Foreign Application Priority Data

Feb. 18, 1978 [DE] Fed. Rep. of Germany ..... 2807076

[51] Int. Cl.[3] ..... F23B 7/00

[52] U.S. Cl. ..... 110/342; 110/218

[58] Field of Search ..... 110/342, 343, 345, 218, 110/216, 221; 236/15 E; 431/76; 44/15 R

[56] References Cited

U.S. PATENT DOCUMENTS

| | | | |
|---|---|---|---|
| 3,540,387 | 11/1970 | McLaren et al. | 110/345 |
| 3,973,898 | 8/1976 | Seider | 236/15 E X |
| 4,111,755 | 9/1978 | Ban et al. | 110/342 X |
| 4,170,447 | 10/1979 | Goldstein | 110/345 X |

FOREIGN PATENT DOCUMENTS 1594690 4/1971 Fed. Rep. of Germany .

*Primary Examiner*—Edward G. Favors
*Attorney, Agent, or Firm*—Karl F. Ross

[57] ABSTRACT

A method of reducing sulfur emissions in boilers fired with brown coal (as an example of low-rank solid fossil fuels with which the invention is usable) wherein finely divided calcium oxide (or calcium-oxide-containing dry materials) as additive is mixed with the fuel before the fuel is introduced into the combustion chamber of the boiler or the burner thereof. Advantageously the additive is mixed with the fuel before the milling thereof. The quantity of finely divided additive which is mixed with the fuel is varied in accordance with the sulfur concentration of the gases at the end of the combustion chamber, e.g. in response to a sulfur dioxide and/or sulfur trioxide sensor, to minimize the sulfur content of the flue gases.

6 Claims, 1 Drawing Figure

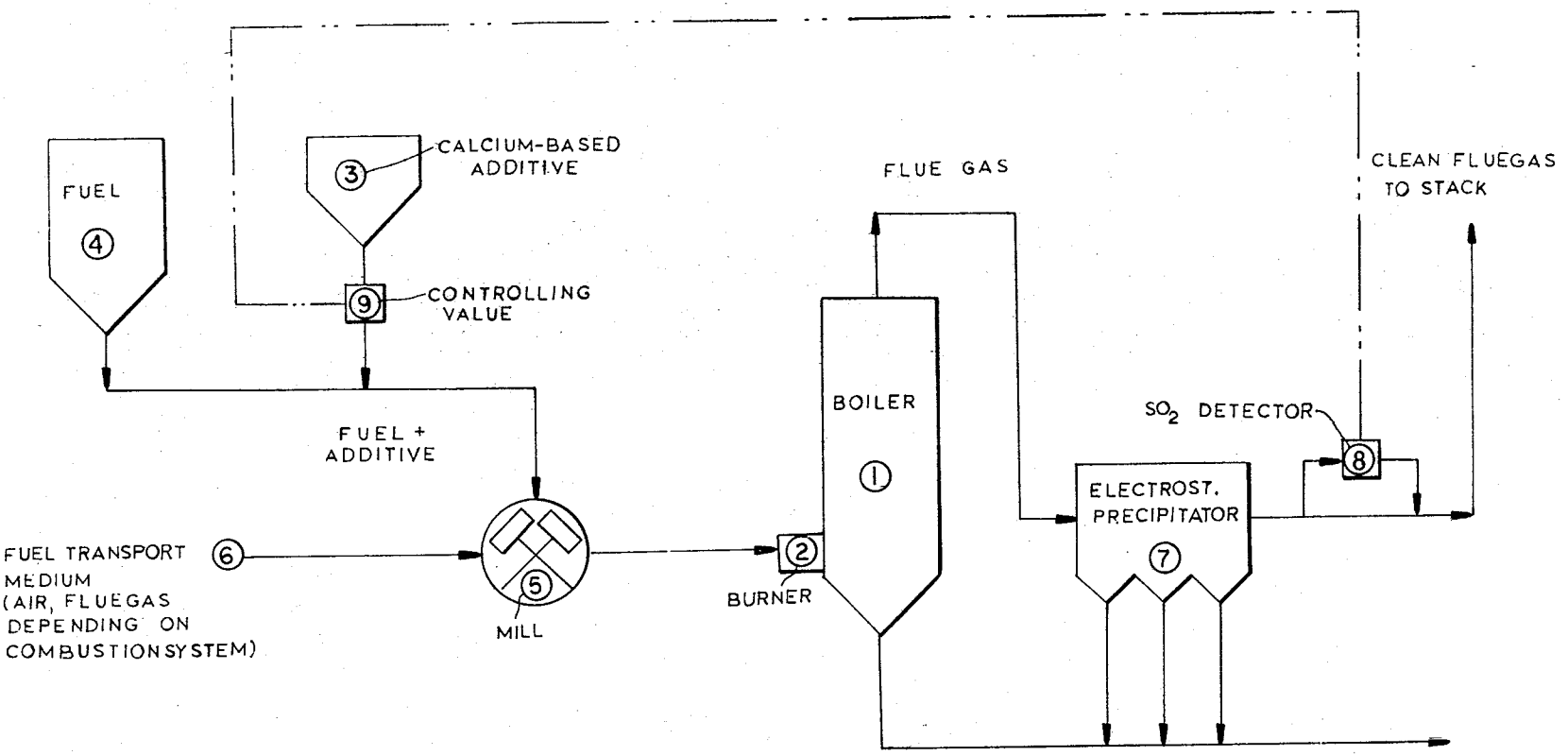
CLEAN FLUEGAS TO STACK
8
$SO_2$ DETECTOR
ELECTROST. PRECIPITATOR
7
FLUE GAS
BOILER
1
2
BURNER
CALCIUM-BASED ADDITIVE
3
CONTROLLING VALUE
9
FUEL + ADDITIVE
5
MILL
FUEL
4
6
FUEL TRANSPORT MEDIUM (AIR, FLUEGAS DEPENDING ON COMBUSTIONSYSTEM)

METHOD OF REDUCING THE SULFUR EMISSIONS FROM BOILERS FIRED WITH BROWN COAL AND, MORE GENERALLY, FROM BOILERS FIRED WITH LOW-RANK SOLID FOSSIL FUELS AND USED IN THE PRODUCTION OF ELECTRIC POWER

CROSS REFERENCE TO RELATED APPLICATION

This application is a continuation-in-part of Ser. No. 008,764 filed Feb. 1, 1979 now abandoned.

FIELD OF THE INVENTION

The present invention relates to a method of reducing sulfur emissions from low-rank coal-fired boilers, especially power-plant boilers.

BACKGROUND OF THE INVENTION

Certain low-rank coals, especially brown coals, lignites and subbituminous coals, hereinafter referred to as low-rank coals or low-rank solid fossil fuels, or both, which generally have a water content of 20% or more by weight, are increasingly of interest in electric-power generation.

When such coals are burned, the flue gas from the combustion chamber generally contains relatively large amounts of sulfur dioxide and, to a far less extent sulfur trioxide, i.e. so-called sulfur emissions in the flue gas.

The low-rank coal with which the present invention is concerned can be distinguished from bituminous or high-rank coal in the sense that it is a younger coal in an earlier form of carbonization.

While low rank coals have been variously characterized e.g. in *Standard Specification for Classification of Coals by Rank,* Designation D 388-66, 5 pp ASTM, Philadelphia, Pa., the expression as used herein is intended to refer to all low rank solid fossil fuels having a water content of at least 20% by weight.

Such coals may contain from 0.2 to more than 0.9% by weight sulfur which, upon combustion in a boiler, e.g. a power-plant boiler, can be transformed to sulfur dioxide and sulfur trioxide.

It can be observed, more generally, that all fossil fuels naturally contain sulfur which, upon combustion, is converted into its oxides, mainly sulfur dioxide but also some sulfur trioxide.

In the industrial combustion of fossil fuels, it is important that the concentrations of sulfur dioxide and sulfur trioxide in the flue gas (more generally sulfur emissions) do not exceed a predetermined value. The standards are generally established by law but it can be said with accuracy that the smaller the sulfur emissions, the safer the discharge of the flue gases into the atmosphere will be.

One possibility is the reduction of the sulfur content of the fuel. When a significant reduction of the sulfur content of the fuel is not possible, one can achieve a partial desulfurization of the flue gas by special treatment of the latter prior to discharging into the atmosphere.

Such special treatments include scrubbing, chemical treatment of the gas and the like.

The economies of such waste-gas desulfurization systems, where they are based on the principle of adsorption or catalysis, are poor because they require relatively large apparatuses, are not able to compensate for significant fluctuations in the sulfur oxide concentrations in the flue gas, and frequently are contaminated or poisoned by other materials which may be present.

Pretreatment systems have likewise been found to be uneconomical for many fuels, including low-rank coals.

In this period of a world-wide shortage of fuels, the poor economies of pretreatment of the fuel or post-treatment of the flue gas to eliminate sulfur have prevented a significant exploitation of low-calorie solid fuels.

In practice it is found that desulfurization systems for the removal of sulfur dioxide and sulfur trioxide from flue gas are more expensive and least economical for the treatment of those flue gases which result from the combustion of low-rank coals.

For completeness mention may be made of the fact that bituminous coal also contains significant quantities of sulfur and that efforts have been made to reduce the sulfur emissions from the combustion of bituminous coal by the blowing of finely divided calcium oxide or calcium-oxide-containing dry materials as additive into the combustion chamber and/or the convective section of an industrial boiler using bituminous coal. However, sulfur dioxide does not readily react with finely divided calcium oxide introduced in this manner so that the practice has not proved to be practicable for large boiler installations.

OBJECTS OF THE INVENTION

It is the principal object of the present invention to provide an improved method of reducing the sulfur emissions of low-rank coal-fired boiler installations.

Another object of this invention is to provide a more efficient and environmentally safe method of utilizing low-rank coal having a higher sulfur content than allowable for direct emission into the atmosphere.

It is yet another object of the invention to provide an improved method of generating electric power utilizing low-rank fossil fuels as the energy source.

SUMMARY OF THE INVENTION

The invention is based upon our most surprising discovery that the disadvantages hitherto encountered in reducing sulfur emissions by the introduction of finely divided calcium oxide or calcium-oxide-containing dry materials, hereinafter referred to as calcium-based additive directly into the combustion chamber or firebox of an industrial furnace such as a power plant boiler, can be eliminated entirely if the finely divided calcium-based additive is mixed with the fuel before it is introduced into the firebox of the boiler so that an intimate mixture of the calcium-based additive and the solid fuel is present from the very moment at which the combustible matter enters the combustion chamber.

In other words, the present invention provides a method of reducing the sulfur emissions of a boiler fired with low-rank coals which comprises admixing the solid fuel with finely divided calcium-based additive before the fuel is introduced into the firebox of the furnace (boiler).

Thus it will be seen that an important, indeed a vital, aspect of the invention is that the calcium-based additive is intimately mixed with the fuel before its introduction into the firebox of the furnace and through the burner.

Surprisingly, one can obtain an effective reaction of the sulfur oxides which are generated in the combustion with the calcium-based additive to solid products which can be readily removed by mechanical, electrostatic or wet-scrubbing processes if one adds an equivalent of the finely divided calcium-based additive to the fuel in accordance with the sulfur content thereof and, especially, if one utilizes a stoichiometric excess of the calcium-based additive. It is indeed surprising that this occurs because the introduction of an equivalent quantity of calcium-based additive in a separate stream to the firebox of a furnace is significantly less effective in combining with the sulfur oxides.

The invention thus provides a reduction of the sulfur emissions of the furnace by the use of finely divided calcium-based additive in low-rank coal-fired boilers by mixing the calcium-based additive with the fuel prior to introduction to the combustion chamber of the furnace.

In boiler firing in which the fuel is treated by a milling-drying process prior to combustion, the invention provides that the calcium-based additive is added to the fuel before the milling-drying step.

According to another feature of the invention, the sulfur oxide (gaseous) content of the flue gases at the end of the combustion chamber is measured and the quantity of finely divided calcium-based additive is controlled in response to this measurement to minimize the sulfur oxide content of the gas.

It has been found that the finely divided calcium-based additive, when intimately admixed to the fuel, reacts chemically to combine the released calcium oxide with the gaseous sulfur oxides in the flue gas after formation of the sulfur oxides. The final result is a solid product, usually calcium sulfate, which is readily removed by mechanical, electrostatic or wet-scrubbing processes.

The solid fuel and the finely ground calcium-based additive intimately mixed therewith are introduced into the combustion chamber through the burner which can be of the usual design. The intimate mixture is important since the reaction between the calcium oxide and the gaseous sulfur oxides is heterogeneous and depends upon the partial pressure of the gaseous components.

While we do not wish to be bound by any theory for the surprising improvement attained with the present invention over systems in which calcium-based additive is scattered into the combustion chamber separated from the fuel stream, we believe that the effect is the result of the fact that the content of the incombustible material of the low-rank coal ensures a relatively low flame temperature which does not allow the optimum temperature range for the reaction of the calcium oxide with the sulfur oxides to be exceeded. Apparently the use of the method in the industrial boilers of power plants ensures a long residence time in this optimum temperature range so that the calcium oxide is not dead burned and remains completely chemically effective for reaction with the sulfur oxides.

Here again mention should be made of the fact that an above-stoichiometric quantity of the calcium oxide may be used simply because of the heterogeneous, hence surface dependent nature of the reaction between the calcium oxide and the sulfur oxides.

Experiments with low-rank coals obtained from the Rhine region of Germany, the so-called brown coals fired in large boilers for steam raising and, ultimately, electricity generation, have indicated that with the addition of calcium-based additive, the gaseous sulfur dioxide content of the flue gas is reduced in proportion to the increasing molar calcium/sulfur ratio of the mixture (fuel plus additive).

Direct control can be achieved in addition by the use of a sulfur dioxide detector at the end of the flue gas duct prior to the stack for regulating the ratio of finely divided calcium-based additive to the ingoing fuel.

Tests have shown further that the instantaneous adjustment of the feed of the calcium-based additive in response to such measurements allows a continuous compensation for varying operating conditions of the furnace, changes in the characteristics of the fuel, greater and lesser fuel demands, etc.

The fuel gas has an extremely low sulfur content and its sulfur dioxide content is held low in spite of short-term fluctuations in the sulfur content of the fuel as is especially pronounced when low-rank coal of the Rhine region is fired.

The solid material recovered from the flue gas, especially calcium sulfate, can be recovered particularly effectively in electrical filters and in a dry form.

The sulfur emissions of the apparatus are reduced well below a maximum permissible value.

In addition the method of the present invention has been found to give some further advantages, namely, an improvement in the separating efficiency of the electrical filter (i.e. the ability of the electrical filter to remove particles from the air) and a reduction in deposits upon the heating surfaces of the boiler, when low-rank coal with certain characteristics is fired.

While it is known that the electrical conductivity of the flue gas in an electrostatic filter influences the function of the latter, experience has shown that the dust removal therein does not always occur in an optimum manner. When, however, finely divided calcium-base additive is mixed to the fuel before combustion and the combustion product is subjected to electrostatic filtration, it is found when low-rank coal with a high moisture content is fired, that the degree of separation in the electrostatic filter increases.

In the firing a low-rank coal in industrial combustion systems, e.g. an electric power plant boiler, the heat transfer surfaces tend to accumulate fireside deposits which, in turn, reduce the efficiency of the system and increase its fuel consumption for a given output. It is therefore indeed surprising that the admixing of solid material such as calcium-based additive to low-rank coal with a certain composition before the introduction of the fuel into the fire box of the furnace reduces such accumulations.

BRIEF DESCRIPTION OF THE DRAWING

The above and other objects, features and advantages of the present invention will become more readily apparent from the following description, reference being made to the accompanying drawing in which the sole FIGURE is a flow diagram illustrating the invention.

SPECIFIC DESCRIPTION

In the drawing the combustion chamber, e.g. a boiler 1 of an electrical power plant is shown, which is supplied via the burner 2 with a mixture of the finely ground calcium-based additive 3 fed onto the fuel flow 4, these two materials then being intimately mixed during the fuel grinding process in the mill 5 and the final solid mixture being transported to the burner by adding a gaseous transport medium 6, which, depending on the combustion system, can be either preheated air and/or inert gas like flue gas recycled from the boiler.

The flue gas leaving the boiler passes the electrostatic precipitator 7 where most of the particulate matter, the so-called ash, is removed from the gas phase. The resulting clean flue gas is bypass-sampled prior to leaving through the stack into the atmosphere, the $SO_2$ content of the gas sample being measured by the $SO_2$ detector 8. The signal of the $SO_2$ detector can be used to monitor the amount of calcium-based additive via the controlling value 9 according to any maximum permissible $SO_2$-emission value to be read from the $SO_2$ detector 8.

SPECIFIC EXAMPLE

In a combustion system of the type illustrated in the drawing, low-rank coal from the Rhine region is fired in a boiler producing 175 tons/hour steam with a specific fuel consumption of approximately 1.25 tons/MWh electrical output.

Typical fuel data on raw coal basis are:
moisture: 57–61%
incombustible matter: 2–10%
total carbon: 22–30%
total sulfur: 0.2–0.8%

From the foregoing it will be apparent that the upper and lower limits (by weight) are as follows:

| Lower Limit | | Upper Limit | |
|---|---|---|---|
| moisture: | 57% | moisture: | 61% |
| noncombustible matter: | 2% | noncombustible matter: | 10% |
| carbon (total): | 22% | carbon (total): | 30% |
| sulfur (total): | 0.2% | sulfur (total): | 0.8% |
| CaO: | 0.5% | CaO: | 1.0% |

With low-rank coals (brown coal) with compositions from the lower and upper limit, the process of the present invention operates effectively.

If A represents the reduced $SO_2$ emission (kg/m$^3$) with respect to the dry flue gas, the value is $A=1\cdot10^{-3}$ for the low-rank coal of the lower limit and $0.85\cdot10^{-3}$ for the low-rank coal of the upper limit with the addition of the following quantity of additives (kg/kg):

| FUEL | S | CaO | ($A = 1 . 10^{-3}$ | $A = 0.85 . 10^{-3}$) |
|---|---|---|---|---|
| Range Limits | $2 . 10^{-3}$ | $5 . 10^{-3}$ | $2.0 . 10^{-3}$ | $2.5 . 10^{-3}$ |
| | $2 . 10^{-3}$ | $10 . 10^{-3}$ | — | — |
| | $8 . 10^{-3}$ | $5 . 10^{-3}$ | $20.9 . 10^{-3}$ | $22.0 . 10^{-3}$ |
| | $8 . 10^{-3}$ | $10 . 10^{-3}$ | $17.0 . 10^{-3}$ | $18.8 . 10^{-3}$ |
| Example | $3 . 10^{-3}$ | $7 . 10^{-3}$ | $4.94 . 10^{-3}$ | $8.84 . 10^{-3}$ |

In the foregoing table S represents the sulfur content of the fuel in kg/kg and CaO the CaO content of the fuel in kg/kg.

Experiments have shown that the desulfurization reaction is practically stoichiometric even when for safety's sake, operations are carried out with a slight excess. The stoichiometric effect is represented by the following relationship:

$$M = -\frac{1}{K}\left(1 - \frac{A}{2 \cdot B(1 - K_o \cdot C)F}\right)$$

wherein

M(kg/kg)=Quantity of additive with reference to quantity of fuel.
A(kg/m$^3$)=Amount of $SO_2$ emission with reference to dry flue gas.
B(kg/kg)=Sulfur content of the fuel.
C(kg/kg)=Calcium oxide content of the fuel.
F(kg/m$^3$)=Constant relating fuel to combustion produced by dry flue gas volume.
$K_o$=Fuel specific reaction constant.
K=Additive specific reaction constant.

In the present case:
$F=0.31$ (air number $\lambda=1.4$)
$K_o=0.05\cdot10^3$
$K=0.035\cdot10^3$

We claim:

1. A method of reducing sulfur emissions in a boiler fired with low-rank coal as a fuel, especially for a power plant, which comprises the steps of:
(a) mixing particulate calcium oxide with low-rank coal having a water content greater than about 20% by weight in a mill-drying stage wherein a mixture thereof is formed, comminuted and dried;
(b) thereafter pneumatically introducing the mill-dried mixture into the firebox of the boiler through a burner thereof; and
(c) burning said mixture in said firebox.

2. The method defined in claim 1, further comprising the steps of:
(d) measuring the gaseous sulfur oxide content of flue gases from said firebox prior to discharge of said flue gases into the atmosphere via a stack; and
(e) controlling the quantity of the calcium oxide mixed with the low-rank coal in response to the measured gaseous sulfur oxide content.

3. The method defined in claim 2, further comprising the step of:
(f) recovering calcium-containing solids from said flue gases by subjecting the flue gases to electrostatic precipitation.

4. The method defined in claim 3 wherein said calcium oxide is mixed with brown coal forming said low-rank coal in a slight stoichiometric excess of the calcium oxide over that which is required to react with all of the sulfur contained in the brown coal.

5. In a method of reducing sulfur emissions from electric power plant boiler fireboxes and in which a sulfur-containing coal is milled and used as the fuel and the fuel is mixed with fine-grained calcium oxide and the mixture is introduced into the firebox of the boiler, the sulfur from the fuel reacting with calcium oxide to form solid reaction products, the improvement wherein the coal combined with the calcium oxide as said fuel is brown coal and the brown coal is combined with the calcium oxide by mill drying them together before the mixture is penumatically introduced into the firebox of the boiler.

6. The improvement defined in claim 5, further comprising the step of controlling the amount of calcium oxide mixed with the brown coal in the mill drier in response to the sulfur oxide content of flue gases from said firebox.

* * * * *